US010859219B2

(12) United States Patent
Butala et al.

(10) Patent No.: US 10,859,219 B2
(45) Date of Patent: Dec. 8, 2020

(54) LUMINAIRE

(71) Applicant: Hubbell Incorporated, Shelton, CT (US)

(72) Inventors: Caitlin Mary Butala, Monroe, CT (US); David John Rector, Mauldin, SC (US); Connie Anna Steadman, Taylors, SC (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 15/760,865

(22) PCT Filed: Sep. 21, 2016

(86) PCT No.: PCT/US2016/052868
§ 371 (c)(1),
(2) Date: Mar. 16, 2018

(87) PCT Pub. No.: WO2017/053414
PCT Pub. Date: Mar. 30, 2017

(65) Prior Publication Data

US 2019/0113190 A1 Apr. 18, 2019

Related U.S. Application Data

(60) Provisional application No. 62/233,101, filed on Sep. 25, 2015.

(51) Int. Cl.
*F21S 8/02* (2006.01)
*F21V 5/02* (2006.01)
(Continued)

(52) U.S. Cl.
CPC ..... *F21S 8/026* (2013.01); *F21S 8/04* (2013.01); *F21S 8/043* (2013.01); *F21V 5/02* (2013.01);
(Continued)

(58) Field of Classification Search
CPC .... F21S 4/20; F21S 4/28; F21V 13/04; F21V 5/02; F21V 5/04; F21V 5/005;
(Continued)

(56) References Cited

U.S. PATENT DOCUMENTS 4,588,259 A * 5/1986 Sheiman ..... G02B 27/26 348/51
4,623,956 A 11/1986 Conti
(Continued)

FOREIGN PATENT DOCUMENTS

WO WO-2011055973 A2 * 5/2011 ..... F21V 29/74

OTHER PUBLICATIONS

PCT/US2016/052868 International Search Report and Written Opinion dated Nov. 18, 2016 (13 pages).

*Primary Examiner* — Alexander K Garlen
*Assistant Examiner* — Colin J Cattanach
(74) *Attorney, Agent, or Firm* — Michael Best & Friedrich, LLP

(57) ABSTRACT

A lighting fixture having a generally cuboid main housing elongated in a longitudinal direction, a light source for emitting light, and a solid light tube of light-permeable material mounted in the main housing for receiving the light. The light tube is elongated in the longitudinal direction and includes a light-emitting surface having generally linear, elongated prisms extending in the longitudinal direction for refracting the light. The lighting fixture also includes a reflecting surface elongated in the longitudinal direction and at least partially facing the light-emitting surface for receiving the refracted light and reflecting the refracted light.

20 Claims, 6 Drawing Sheets

(51) Int. Cl.

| | |
|---|---|
| ***F21V 7/00*** | (2006.01) |
| ***F21V 13/04*** | (2006.01) |
| ***F21S 8/04*** | (2006.01) |
| ***F21V 17/02*** | (2006.01) |
| ***F21V 21/04*** | (2006.01) |
| ***F21Y 103/10*** | (2016.01) |
| ***F21Y 115/10*** | (2016.01) |
| ***F21V 5/00*** | (2018.01) |
| ***F21V 5/08*** | (2006.01) |
| ***F21V 5/04*** | (2006.01) |

(52) U.S. Cl.
CPC ..... *F21V 7/005* (2013.01); *F21V 13/04* (2013.01); *F21V 17/02* (2013.01); *F21V 21/04* (2013.01); *F21V 5/002* (2013.01); *F21V 5/005* (2013.01); *F21V 5/04* (2013.01); *F21V 5/043* (2013.01); *F21V 5/045* (2013.01); *F21V 5/08* (2013.01); *F21V 7/0091* (2013.01); *F21Y 2103/10* (2016.08); *F21Y 2115/10* (2016.08)

(58) Field of Classification Search
CPC . F21V 5/002; F21V 5/08; F21V 5/043; F21V 5/045; F21V 7/005; F21V 7/0091
See application file for complete search history.

(56) References Cited

U.S. PATENT DOCUMENTS 5,274,533 A 12/1993 Neary et al.
5,613,769 A * 3/1997 Parkyn, Jr. ..... G02B 19/0028 362/338
5,655,832 A * 8/1997 Pelka ..... F24S 23/31 362/296.09
7,029,148 B2 4/2006 White et al.
8,408,775 B1 * 4/2013 Coleman ..... F21V 7/04 362/602
8,770,779 B2 7/2014 Steadman et al.
8,854,796 B2 10/2014 Wilcox
9,057,807 B2 * 6/2015 Yoo ..... G02B 6/003
9,719,662 B1 * 8/2017 Householder ..... F21V 5/045
9,784,433 B2 * 10/2017 Camp ..... B60Q 3/64
2005/0286145 A1 * 12/2005 Silhengst ..... F21V 5/045 359/742
2006/0291201 A1 * 12/2006 Smith ..... F21V 5/04 362/227
2009/0201676 A1 8/2009 Eynden
2010/0142200 A1 * 6/2010 Huang ..... F21V 5/045 362/235
2010/0208490 A1 * 8/2010 Tsuchiya ..... G02B 6/003 362/606
2012/0092876 A1 * 4/2012 Chang ..... F21V 5/00 362/326
2012/0134139 A1 * 5/2012 Jang ..... G02F 1/133615 362/97.2
2013/0077304 A1 * 3/2013 Gordin ..... F21K 9/90 362/235
2013/0241435 A1 9/2013 Lamvik et al.
2013/0301240 A1 * 11/2013 Liu ..... F21V 13/04 362/97.1
2014/0003039 A1 1/2014 Steadman et al.
2014/0092596 A1 * 4/2014 Deutsch ..... F21S 4/28 362/236
2016/0076743 A1 * 3/2016 Deutsch ..... F21V 7/0091 362/268
2016/0265745 A1 * 9/2016 Huang ..... H01L 33/58
2017/0234523 A1 * 8/2017 Krijn ..... F21S 8/033 362/145

* cited by examiner

LUMINAIRE

CROSS-REFERENCE TO RELATED APPLICATION

This application claims the benefit of U.S. Provisional Patent Application No. 62/233,101, filed Sep. 25, 2015, the entire contents of which are hereby incorporated by reference.

BACKGROUND

The present disclosure relates to lighting fixtures, such as "wall wash" luminaire adapted primarily to illuminate a nearby wall.

Typically, a wall wash luminaire is mounted in a ceiling for illuminating a nearby area of the room, such as a wall or other standing object.

SUMMARY

In one aspect, the disclosure provides a lighting fixture having a generally cuboid main housing elongated in a longitudinal direction, a light source for emitting light, and a solid light tube of light-permeable material mounted in the main housing for receiving the light. The light tube is elongated in the longitudinal direction and includes a light-emitting surface having generally linear, elongated prisms extending in the longitudinal direction for refracting the light. The lighting fixture also includes a reflecting surface elongated in the longitudinal direction and at least partially facing the light-emitting surface for receiving the refracted light and reflecting the refracted light.

In another aspect, the disclosure provides a lighting fixture having a main housing being elongated in a longitudinal direction and having an elongated opening, a light source for emitting light, and a solid light tube of light-permeable material mounted in the main housing for receiving the light. The light tube is elongated in the longitudinal direction and includes a light-emitting surface having generally linear, elongated prisms extending in the longitudinal direction for refracting the light through the opening.

In yet another aspect, the disclosure provides a light tube for refracting light in a lighting fixture. The light tube includes a solid body of light permeable material elongated in a longitudinal direction. The light tube has a base having a light-receiving surface configured to receive light from a light source, and a light-emitting surface. The light-emitting surface has generally linear, elongated prisms extending in the longitudinal direction for refracting the light. The body is configured to internally transmit light from the light-receiving surface to the light-emitting surface. The body is longer in the longitudinal direction than in a direction generally perpendicular to the longitudinal direction from the base to the light-emitting surface.

In yet another aspect, the disclosure provides a lighting fixture for installation in a ceiling. The lighting fixture includes a main housing being elongated in a longitudinal direction, a light source for emitting light, a light tube, and a reflecting surface. The light tube is mounted in the housing for receiving the light and is elongated in the longitudinal direction. The light tube includes a light-emitting surface having generally linear, elongated prisms extending in the longitudinal direction for refracting and/or diffusing the light. The reflecting surface at least partially faces the light-emitting surface for receiving the refracted and/or diffused light and reflecting the light.

In another aspect, the disclosure provides a light tube for diffusing and directing light in a lighting fixture. The light tube includes a body elongated in a longitudinal direction and a light-emitting surface having generally linear, elongated prisms extending in the longitudinal direction for diffusing and directing light.

Other aspects of the disclosure will become apparent by consideration of the detailed description and accompanying drawings.

DETAILED DESCRIPTION

Figure 1:
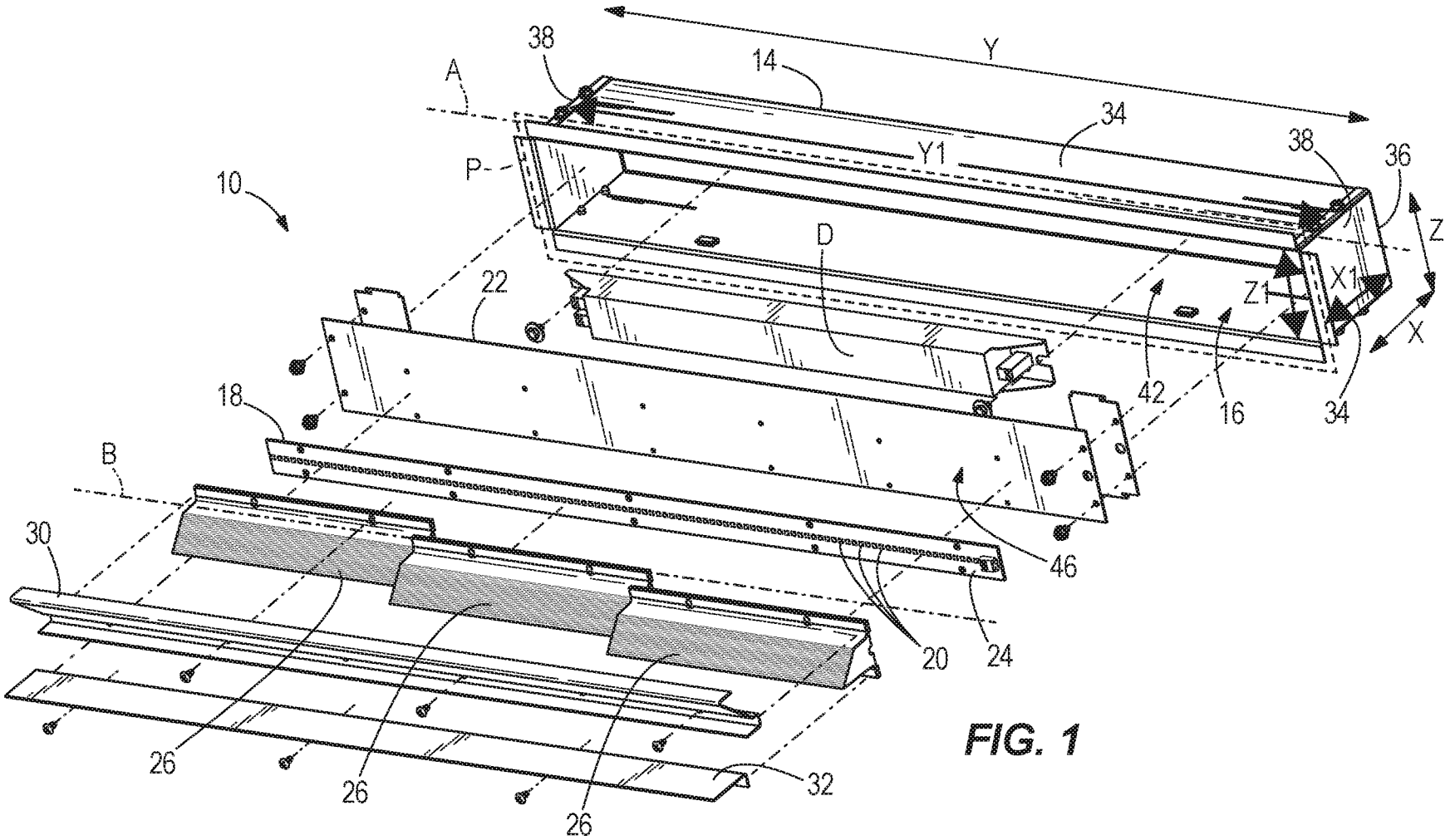
FIG. 1 is an exploded view of a lighting fixture in accordance with the disclosure.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

The figures illustrate a luminaire, or lighting fixture 10, that may be installed in an installation surface such as a ceiling C, e.g., a drop ceiling, for directing light towards a wall W and/or towards a room side R generally opposite the wall W. The lighting fixture 10 may also be installed in a wall W or mounted on a frame (not shown) as a standalone structure, such as a floor lamp or table lamp. The lighting fixture 10 may be recessed or surface mounted and is electrically connected to a power source (not shown), such as a utility supply of electricity, a battery, a solar cell, a fuel cell, an alternator, a generator, etc. The lighting fixture 10 may include a transformer (not shown), such as a step-down transformer and/or an electronic driver D. For example, the lighting fixture 10 may include the power components described in commonly owned U.S. Pat. No. 8,770,779, issued Jul. 8, 2014, the entire contents of which are incorporated herein by reference.

The lighting fixture 10 includes a main housing 14 substantially enclosing and supporting the power components such as the driver D, a lamp 18 (which may also be referred to herein as a light source 18), a mounting plate 22 for the light source 18, light tubes 26 for directing light from the light source 18, a first reflector 30, and a second reflector 32.

Figure 9:
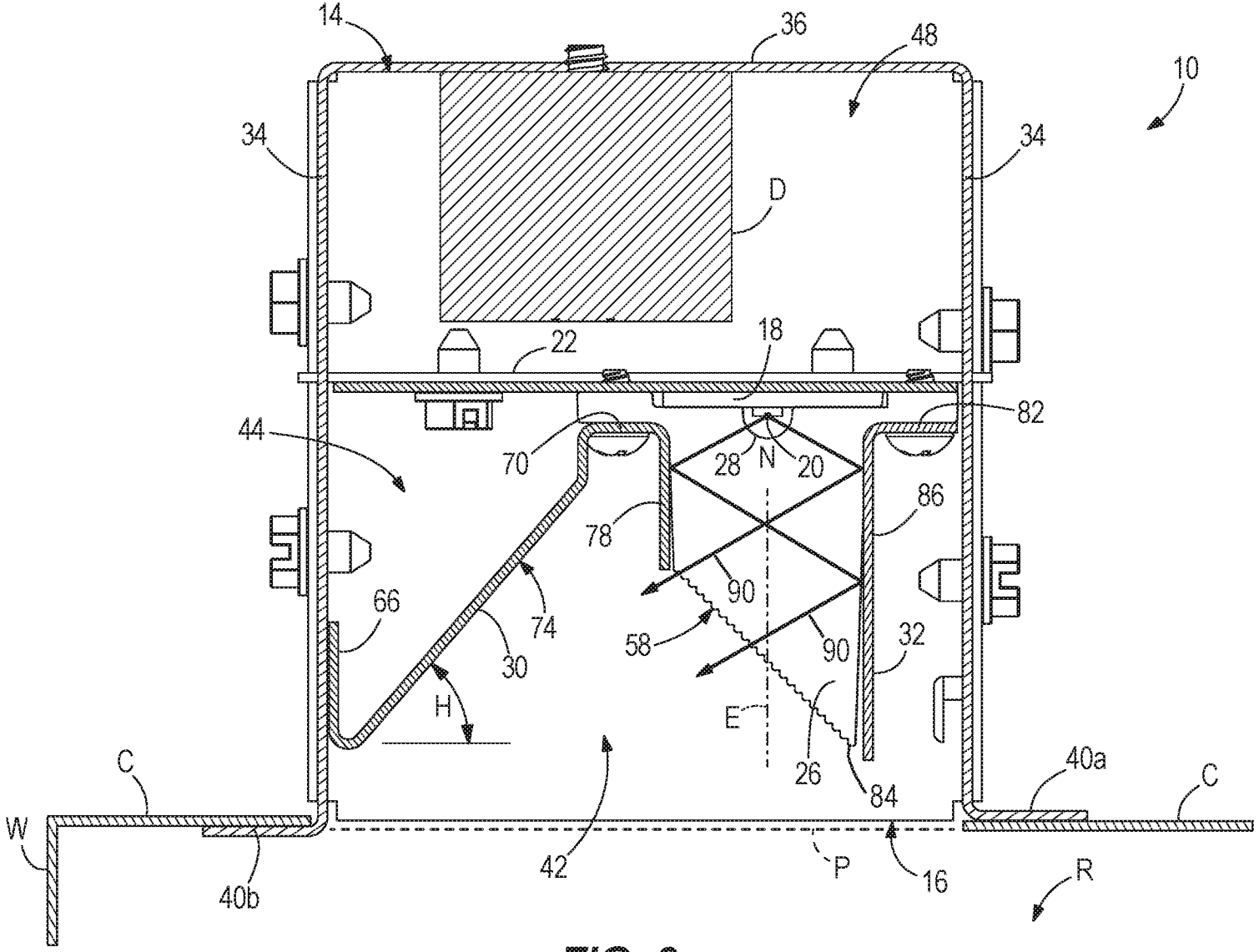
FIGS. 9-10 are side cross-sectional views through the lighting fixture of FIG. 1 assembled for operation.
Figure 10:
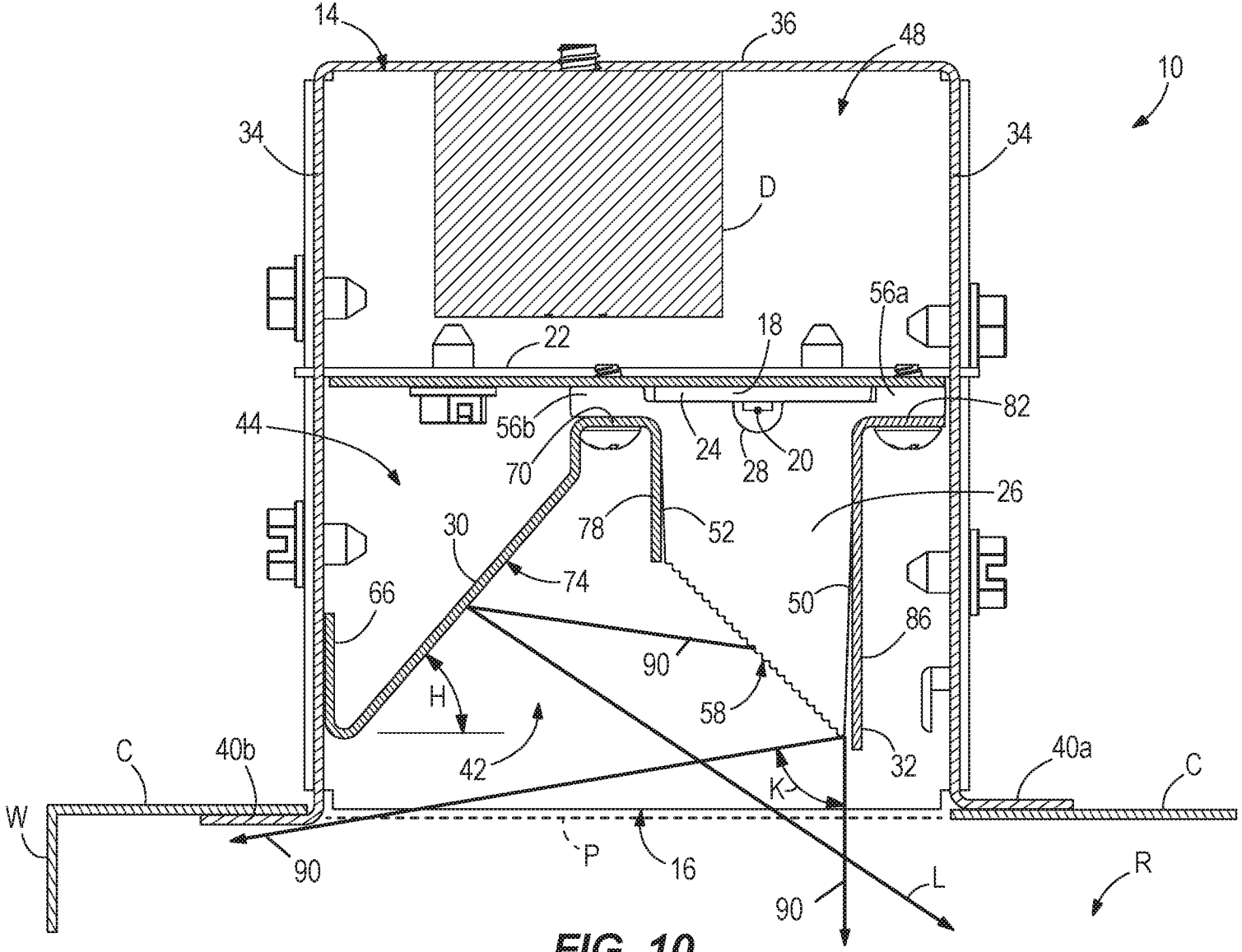

The main housing 14 generally defines an opening 16 extending along an output plane P acting as an outlet for light to exit the lighting fixture 10. The main housing 14 may include a pair of flanges 40*a*, 40*b* substantially parallel with the output plane P for seating with the ceiling C or other installation surface. As illustrated in FIGS. 9-10, the flanges

40*a*, 40*b* are offset to accommodate ceiling tiles in a drop ceiling. However, in other constructions, the flanges 40*a*, 40*b* may be aligned to provide a trim flange against a mounting surface, such as drywall. In yet other constructions, the lighting fixture 10 need not include flanges and may be mounted in any other suitable way.

The main housing 14 has a generally cuboid shape having at least one open face, e.g., the opening 16. The main housing 14 may have any generally cuboid shape, such as rectangular, square, parallelepiped, frustum, etc. For example, the main housing 14 may have an elongated rectangular cuboid shape defining a longitudinal axis A (FIG. 1) and is defined by a plurality of walls, such as elongated sidewalls 34 and an elongated top wall 36 extending generally parallel to the longitudinal axis A and end walls 38 generally normal to the longitudinal axis A. The walls 34, 36, 38 are generally perpendicular to each other at right angles, but may be arranged to form other parallelepipeds or any other elongated shape, such as a cylinder, an oblong shape, an irregular elongated shape, etc. The opening 16 is also generally elongated in the direction of the longitudinal axis A. The main housing 14 includes a recess or cavity 42 defined within the sidewalls 34, the top wall 36, and the end walls 38 providing a space for receiving the power components, the mounting plate 22, the light source 18, the light tubes 26, and the reflectors 30, 32.

Dimensions of the main housing 14 may be chosen depending on the application, e.g., to accommodate the desired length of light distribution down a given hallway or along a given piece of artwork. However, for example only, in one construction the elongated sidewalls 34 of the lighting fixture 10 have a length Y1 in a direction Y (FIG. 1) parallel to the longitudinal axis A of about 24 inches, or between about 12 to about 36 inches, or between about 18 and about 28 inches, etc. Furthermore, the elongated sidewalls 34 have a height X1 in a direction X (FIG. 1) generally perpendicular to the longitudinal axis A of about 3 inches, or between about 2 and 4 inches, or between about 1 and 5 inches, etc., and may have other dimensions. Furthermore, the top wall 36 has a width Z1 in a direction Z (FIG. 1) generally perpendicular to the longitudinal axis A of about 3.5 inches, or between about 3 and 4 inches, or less than about 4 inches, or between about 2 and 5 inches, or less than about 5 inches, or between about 1 and 6 inches, or less than about 6 inches, or less than about 7 inches, etc., and may have other dimensions. The width in the direction Z of the opening 16 generally corresponds with the width Z1 of the top wall 36 and may be slightly less than the width of the top wall 36 (e.g., about 3 inches). Compared with prior art devices, the width of the opening 16 is relatively narrow. The lighting fixture 10 may be scaled or adjusted to any other desirable dimension. Furthermore, the main housing 14 may be made from steel, aluminum, or any other suitable material, and may or may not be painted.

The mounting plate 22 is generally planar, elongated, and extends generally parallel to the longitudinal axis A. The mounting plate 22 is coupled to the main housing 14 by way of fasteners, such as screws, or by snap fits, adhesive, bonding, welding, or any other suitable coupling. The mounting plate 22 provides a mounting surface 46 for supporting the light source 18. For example, the light source 18 is coupled to the mounting plate 22 by way of fasteners, such as screws, or by snap fits, adhesive, bonding, welding, or any other suitable coupling. In other constructions, the light source 18 may be mounted directly to the main housing 14 or in any other suitable way mounted within the main housing 14. The mounting plate 22 may also act as a heat sink for the light source 18.

As illustrated in FIGS. 9-10, the mounting plate 22 is mounted in the cavity 42 of the main housing 14 generally parallel to the top wall 36 and the output plane P to define a first compartment 44 on one side and define a second compartment 48 on the opposite side. The first compartment 44 is disposed between the mounting plate 22, the output plane P, and the elongated sidewalls 34 for receiving the light source 18, the light tubes 26, and the first and second reflectors 30, 32. The second compartment 48 is disposed between the mounting plate 22, the elongated sidewalls 34, and the top wall 36 for receiving the driver D and other power components.

Dimensions of the mounting plate 22 generally correspond with the dimensions of the main housing 14 to fit substantially within the main housing 14 as described above, particularly the length Y1 in the direction Y and width Z1 in the direction Z. For example only, in the illustrated construction, the mounting plate 22 may have a length in the direction Y between about 20 and about 24 inches and a width in the direction Z between about 2 and about 3.5 inches.

The light source 18 may include one or more light emitting diodes (LEDs) 20 (FIG. 1) or other solid state lamp(s). The light source 18 may also include other types of lamps, such as halogen, incandescent, neon, fluorescent, oil, gas, or any other suitable lamp that emits light of a desired type (e.g., warm, cool, soft, bright, colored, white, etc.). The light source 18 may form a generally continuous light-emitting surface or a plurality of discrete and separated light sources, which may be evenly spaced, unevenly spaced, or clustered in any manner and disposed generally along the direction of the longitudinal axis A. In the illustrated construction, the light source 18 includes a plurality of LEDs 20 arranged in a linear array on a substrate 24. The light source 18 extends substantially the length Y1 of the main housing 14 in the direction Y. In other constructions, the LEDs 20 may be arranged in other patterns and other suitable lamps may be employed. For example, the LEDs 20 may be arranged in multiple rows, straight rows, curved rows, evenly spaced, unevenly spaced, etc. The arrangement may be made to suit the type of lamp being employed and the desired output distribution of light. For example, the LEDs 20 each emit an approximately uniform hemisphere of light. In some constructions, the distribution may be non-uniform, e.g., concentrated towards a surface-normal of the light source 18.

Figure 3:
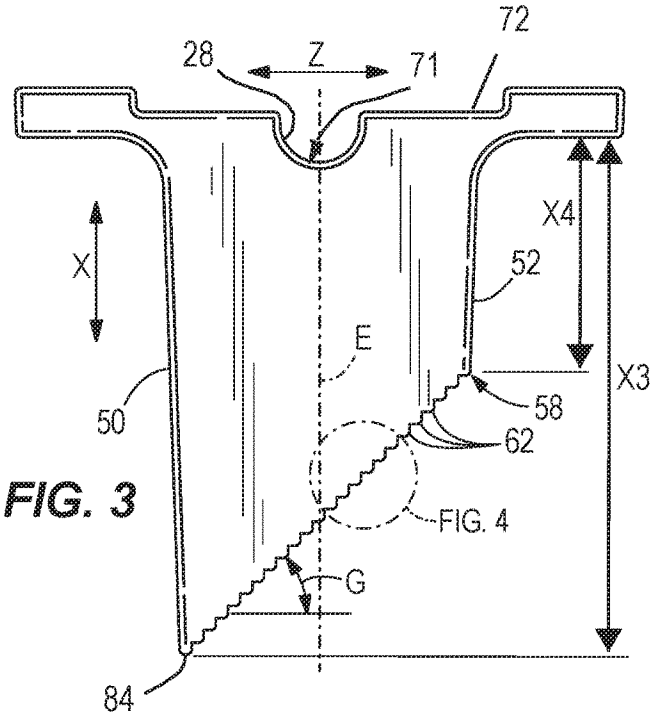
FIG. 3 is a side view of the light tube of FIG. 2.
Figure 4:
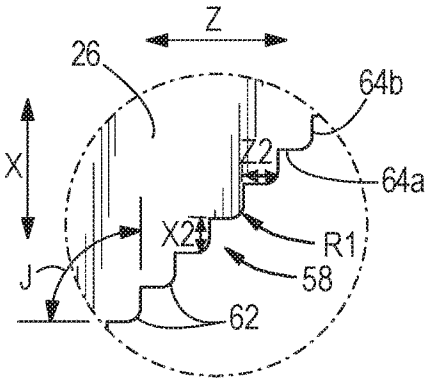
FIG. 4 is a detail view of a portion of the light tube shown in FIG. 3.
Figure 2:
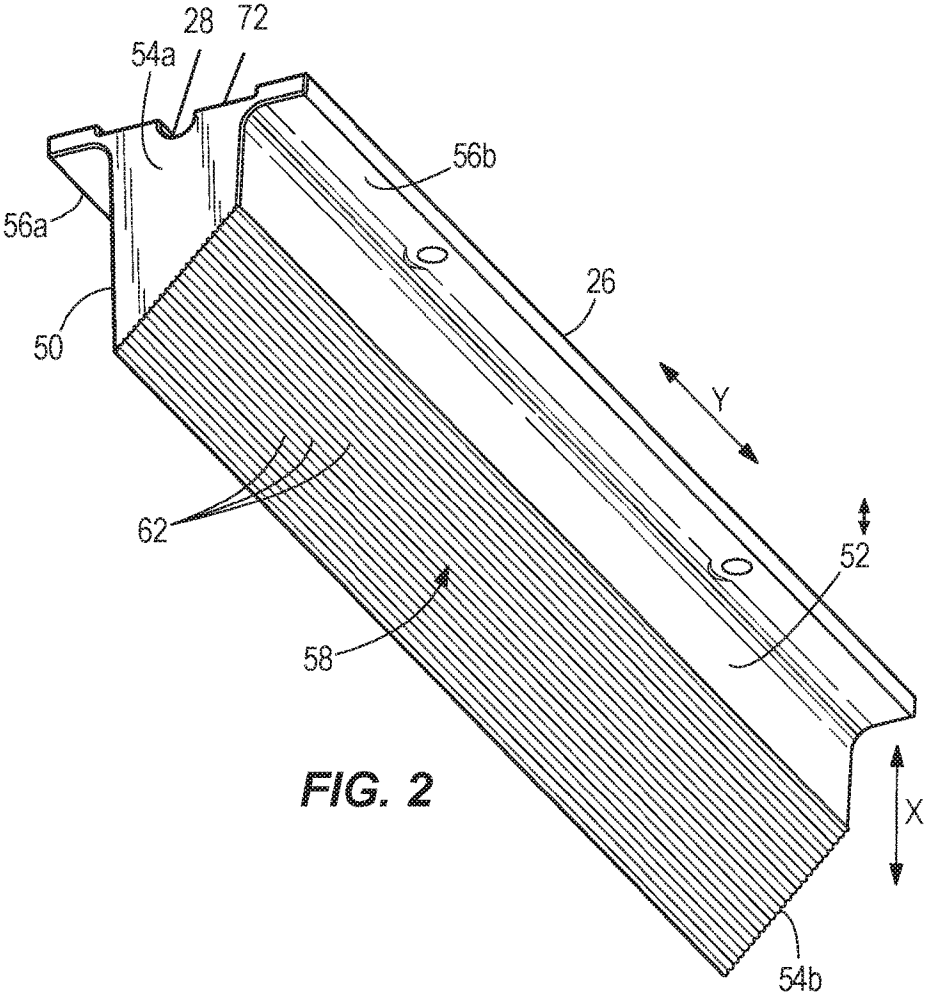
FIG. 2 is a perspective view of a light tube for the lighting fixture of FIG. 1.
Figure 6:
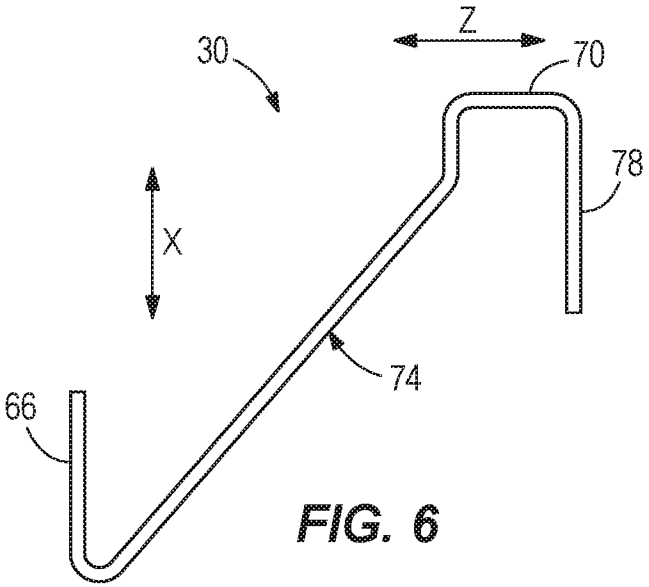
FIG. 6 is a side view of the first reflector of FIG. 5.
Figure 5:
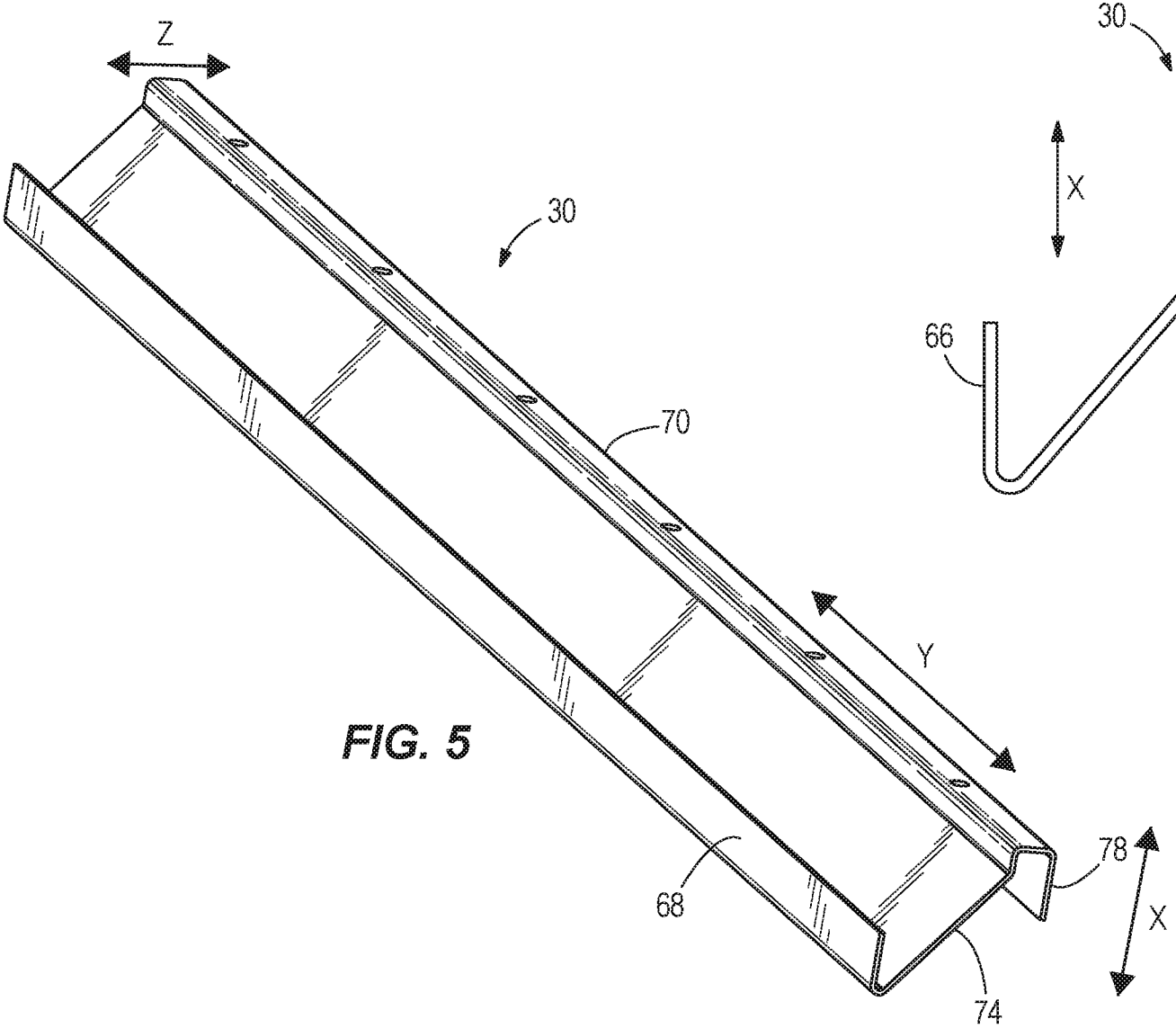
FIG. 5 is a perspective view of a first reflector for the lighting fixture of FIG. 1.
Figure 8:
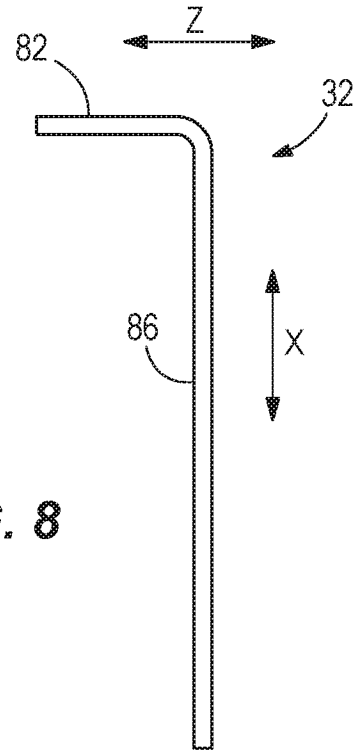
FIG. 8 is a side view of the second reflector of FIG. 7.
Figure 7:
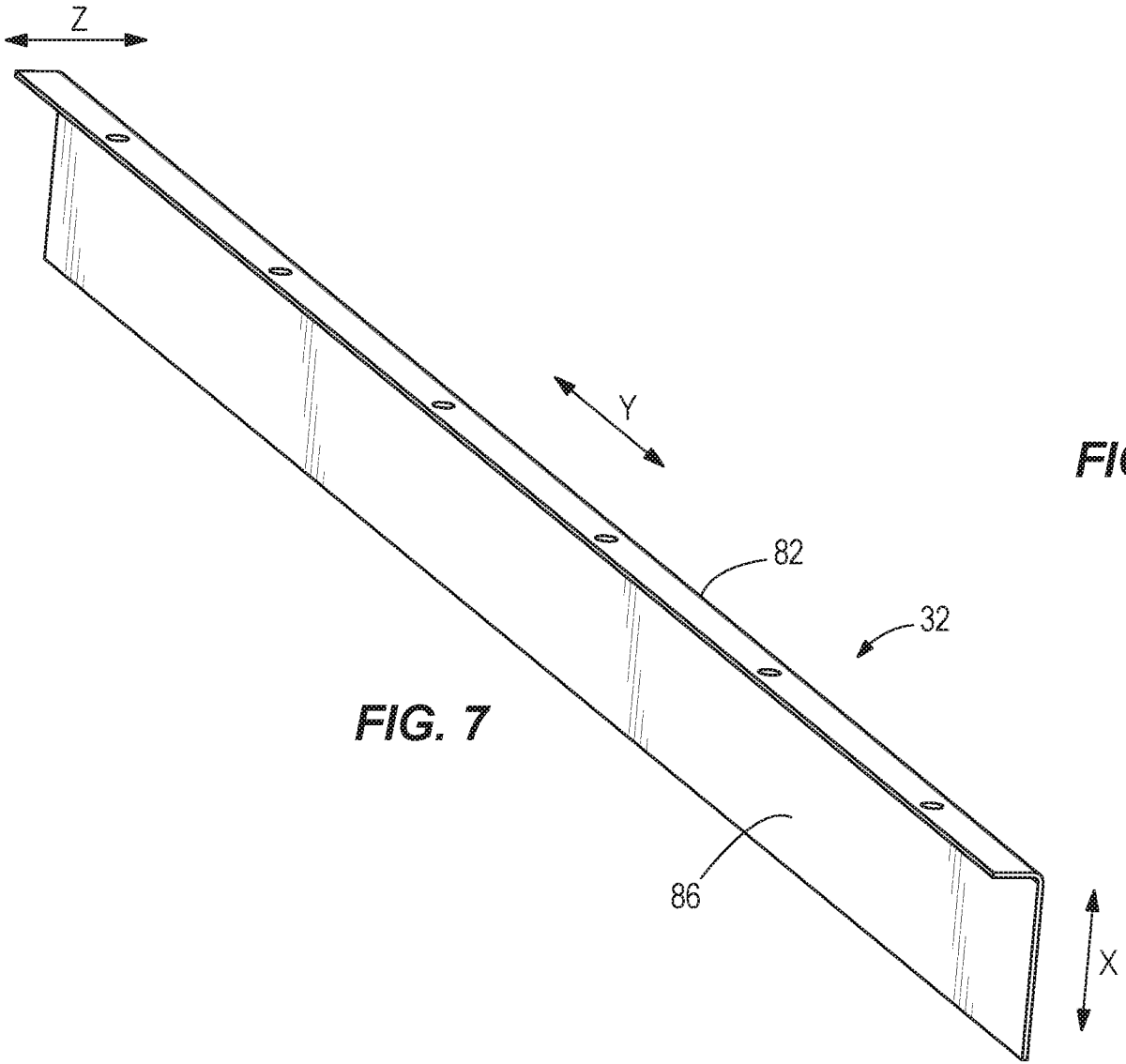
FIG. 7 is a perspective view of a second reflector for the lighting fixture of FIG. 1.

FIGS. 2-4 illustrate one of the light tubes 26 in greater detail. In the illustrated construction, the lighting fixture 10 includes three light tubes 26 arranged longitudinally end-to-end in a direction generally parallel to the longitudinal axis A. The light tubes 26 are generally elongated and disposed coaxially along a longitudinal axis B (FIG. 1) substantially parallel to the longitudinal axis A when mounted with respect to the main housing 14. Each light tube has an extruded three-dimensional shape extending in the direction of the longitudinal axis A. The light tubes 26 are mounted to the mounting plate 22 such that the light source 18 is substantially sandwiched between the light tubes 26 and the mounting plate 22, e.g., by way of fasteners, such as screws, or by snap fits, adhesive, bonding, welding, or any other suitable coupling. The disclosure is not limited to three light tubes 26 arranged end-to-end in series along the longitudinal axis B. In other constructions, the lighting fixture 10 may include a single light tube 26 or a plurality of light tubes 26, e.g., two light tubes 26, four light tubes 26, or any number of light tubes 26. The light tubes 26 may be formed discretely, coupled together, or formed as a single piece. The light tubes 26 may be arranged in different configurations, such as side-by-side. For example, the light tubes 26 may be arranged generally parallel to each other but need not be disposed coaxially with respect to each other. In some constructions, the light tubes 26 may be arranged transverse to each other to produce other desired lighting effects. Thus, the lighting fixture 10 includes at least one light tube 26 as described in greater detail below.

The light tube 26 includes sidewalls, such as an extended wall 50 (extended generally in the X direction perpendicular to the axis B), a short wall 52 generally opposite the extended wall 50, and a pair of sidewalls 54*a*, 54*b* extending between the short wall 52 and the extended wall 50. The light tube also includes a base 72 extending between the short wall 52, the extended wall 50, and the sidewalls 54*a* and 54*b*. The base 72 extends generally parallel to the axis B and includes a light-receiving surface 71 and a pair of base flanges 56*a* and 56*b*. The walls 50, 52, 54*a*, 54*b* define an axis E (FIG. 3) generally normal to the axis B extending generally away from the base 72 and the base flanges 56*a*, 56*b*. The extended wall 50 extends farther from the base 72 in the direction of the axis E than does the short wall 52. The base flanges 56*a*, 56*b* provide a connecting structure for coupling the light tube 26 to the mounting plate 22. The light tube 26 includes a recess 28 disposed between the base flanges 56*a*, 56*b* at the base 72 defining a cavity for receiving the light source 18. A surface on the light tube 26 defining the recess 28 includes the light-receiving surface 71. The light source 18 is disposed in the recess 28 directly between the light tube 26 and the mounting plate 22 to emit light internally through the light tube 26 (as illustrated by rays 90 in FIG. 9) primarily in the direction of the axis E away from the mounting plate 22. The light-receiving surface 71 defines an entrance (e.g., the inner concave surface of the recess 28) for the light from the light source 18 to enter into the light tube 26 and is ideally configured to be generally normal to the light rays entering the light tube 26 to reduce light losses from the LED 20. Thus, in the illustrated construction, the LEDs 20 emit light rays generally in a hemispherical shape and, accordingly, the recess 28 has a corresponding semi-circular cross-section (FIGS. 9-10). The recess 28 may extend linearly in the direction of axis B to accommodate the linear array of LEDs 20 (e.g., as a semi-cylindrical shape), or there may be a plurality of recesses 28, each recess 28 being semi-spherical (e.g., hemispherical) and corresponding to a single LED 20 in the array. For example, the light-receiving surface 71 may be an elongated shape such as a tubular shape. The tubular shape may have a cross section that is polygonal, curved, arcuate, circular or semi-circular (i.e., cylindrical or semi-cylindrical), etc. In the illustrated construction, the light-receiving surface 71 is semi-cylindrical. An air gap may be disposed between the LED 20 and light-receiving surface 71 to accommodate manufacturing tolerances.

The light tube 26 also includes a light-emitting surface 58 extending generally in a plane and being elongated in a direction generally parallel to longitudinal axis B. The light-emitting surface 58 is disposed at an end of the light tube 26 generally opposite the base 72 and configured to refract and/or diffuse light exiting the light tube 26. The overall shape (e.g., extending in a plane as shown in FIG. 2 or a line as shown in the side view of FIG. 3) of the light-emitting surface 58 is transverse to the base 72, and similarly transverse to the output plane P, by an angle G (FIG. 3) of about 45 degrees, and may be between about 40 and about 50 degrees, between about 30 and about 60 degrees, or another suitable orientation for distributing light across a desired range. In the illustrated construction, the light-emitting surface 58 at least partially faces (has a form factor with) the first reflector 30 and the wall W to distribute light directly on both the wall W and the first reflector 30. The light-emitting surface 58 includes one or more surface features, such as elongated prisms 62, or steps, each extending linearly generally parallel to the longitudinal axis B along the length of the light tube 26 in the direction Y. The light-emitting surface 58 may have, instead of or in addition to elongated prisms 62, other surface features such as a rough texture such as a sand blasted texture, or alternate texture, that diffuses and/or refracts light.

As illustrated in the detail of FIG. 4, the elongated prisms 62 are substantially uniform, elongated prisms 62 each having a pair of transverse, elongated surfaces 64*a*, 64*b* meeting at an edge, or a rounded corner, at an included angle J. In the illustrated construction, the angle J is approximately 90 degrees. Each elongated surface 64*b* has a step height X2 in the X direction of about 0.03 in. (e.g., about 0.01 to about 0.05 in., or about 0.02 to about 0.04 in.), the elongated surface 64*a* has a step depth Z2 in the Z direction of about 0.03 in. (e.g., about 0.01 to about 0.05 in., or about 0.02 to about 0.04 in.), and a rounded edge having a radius or round R1 of about 0.012 in. (e.g., about 0.005 in. to about 0.017 in., or about 0.010 in. to about 0.014 in.). Thus, the prisms 62 are approximately right angle prisms and the light-emitting surface 58 includes about 20-25 prisms per inch, or more specifically between about 22-24 prisms per inch, or even more specifically about 23 prisms per inch. In yet other constructions, the prisms 62 may have other angles and dimensions and may be scaled or skewed to obtain desired light distribution effects. For example, the light-emitting surface 58 may include more or fewer prisms 62 per inch, e.g., between, about 5 prisms per inch to about 100 prisms per inch, or other prism densities. The prisms 62 need not be uniform in angle or dimension relative to each other. For example, if a non-uniform light source 18 is used (e.g., if the light source directs more light in some directions than other directions), then the angles J and dimensions of the prisms 62 (e.g., X2, Z2, and R1) can vary across the light-emitting surface 58 in order to compensate for, and redistribute, the non-uniformity of the light source 18 in a desired manner.

The light tube 26 is substantially solid and formed from a light-permeable material, such as a transparent or translucent material (e.g. acrylic or any other suitable material). The walls 50, 52, 54*a*, 54*b* may be light-permeable or coated with a reflective material, such as a paint or coating, for reflecting the light generally along the axis E away from the mounting plate 22 and exiting the light-emitting surface 58. However, the walls 50, 52, 54*a*, 54*b* need not be coated. The light tube 26 has internal reflection, similar to a fiber optic cable or a light pipe, for directing the light generally along the axis E.

Dimensions of the light tube 26 will depend on the number of light tubes employed, the desired light distribution, etc. Collectively, the light tubes 26 generally extend the length Y1 in the direction Y of the main housing 14, e.g., about 20 to 24 inches in the illustrated construction. The extended wall 50 has a height X3 in the direction X of about 1.0 to 1.5 inches, e.g., about 1.3 inches. The short wall 52 has a height X4 in the X direction of about 0.2 to about 0.9 inches, e.g., about 0.6 inches. The light tube(s) 26 may have any other dimensions based on the desired application. In the illustrated construction, a tip 84 (FIG. 3) of the light tube 26

(e.g., an end of the light-emitting surface 58 intersecting the extended wall 50) is spaced from the output plane P of the lighting fixture 10. However, in other constructions, the light tube 26 may extend adjacent to or to the output plane P to increase the spread of light emitted from the output plane P (FIG. 9), as will be described in greater detail below.

With particular reference to FIGS. 5-6 and 9-10, the first reflector 30 includes a wall mounting flange 66, a mounting portion 70, a reflecting surface 74, and a reflecting wall 78. The first reflector 30 is mounted to the base flange 56*b* of the light tube 26 at the mounting portion 70, which sandwiches the base flange 56*b* between the mounting portion 70 and the mounting plate 22. The wall mounting flange 66 braces against the elongated sidewalls 34 of the main housing 14. In other constructions, the first reflector 30 may be mounted in other suitable ways.

The reflecting wall 78 is disposed directly adjacent the short wall 52 of the light tube 26 and provides a backing for the short wall 52 for keeping light reflected internally within the light tube 26. The reflecting wall 78 may be formed with the short wall 52 when the short wall 52 includes an integrated reflective surface, such as the reflective coating described above.

The reflecting surface 74 is the main reflecting surface of the light fixture 10 and is angled with respect to the output plane P by an angle H of between 0 and 90 degrees, e.g., between about 30 to about 70 degrees, more specifically between about 40 to about 60 degrees, even more specifically between about 45 to about 55 degrees, and most specifically about 49 degrees. The reflecting surface 74 is elongated in the direction of the longitudinal axis A and may be generally planar as illustrated, but may alternatively be curved, parabolic, ellipsoidal, or alternate shapes in other constructions. The reflecting surface 74 may be disposed at any angle to create the desired lighting distribution effects. As illustrated in FIG. 10, the reflecting surface 74 faces at least partially away from the wall W and faces at least partially towards the light-emitting surface 58 to receive light therefrom. Thus, the reflecting surface 74 reflects the light from the light tube 26 generally towards the room side R and away from the wall W. As such, the first reflector 30 may be a room reflector for reflecting the light towards the room side R.

Dimensions of the first reflector 30 may be varied depending on the application and the desired light distribution. Generally, the first reflector 30 extends the length Y1 of the main housing 14 in the direction Y, e.g., about 21 inches, or between about 20 and about 24 inches, etc. Furthermore, the reflecting surface 74 and the reflecting wall 78 may be formed separately or integrated as one piece. The first reflector 30 may be made from a reflective material such as steel, aluminum, or any other suitable material.

With particular reference to FIGS. 7-10, the second reflector 32 includes a mounting portion 82 and a reflecting wall 86. The second reflector 32 is mounted to the base flange 56*a* of the light tube 26 at the mounting portion 82, which sandwiches the base flange 56*a* between the mounting portion 82 and the mounting plate 22. In other constructions, the second reflector 32 may be mounted in other suitable ways. The second reflector 32 is elongated in the direction of the longitudinal axis A and may be generally planar as illustrated, or may alternatively be curved, parabolic, ellipsoidal, or alternate shapes in other constructions.

The reflecting wall 86 is disposed directly adjacent the extended wall 50 of the light tube 26 and provides a backing for the extended wall 50 for keeping light reflected internally within the light tube 26. The reflecting wall 86, and indeed the entire second reflector 32, may be formed as part of the extended wall 50 of the light tube 26 when the extended wall 50 includes an integrated reflective surface, such as the reflective coating described above.

Dimensions of the second reflector 32 may be varied depending on the application and the desired light distribution. Generally, the second reflector 32 extends the length Y1 of the main housing 14 in the direction Y, e.g., about 21 inches, or between about 20 and about 24 inches, etc. The second reflector 32 may be made from a reflective material such as steel, aluminum, or any other suitable material.

In operation, the lighting fixture 10 directs light from the light source 18 through the light tube(s) 26 to the light-emitting surface 58 primarily in the direction of the longitudinal axis E by any combination of internal reflection (as a property of the light tube 26 itself) and reflection (as a property of any coating applied to the light tube 26 or of the reflecting walls 78, 86). FIGS. 9-10 illustrate ray traces 90 simulating light distribution through and from the lighting fixture 10. As shown, most of the light is distributed towards the wall W and has a wide range of distribution from the top of the wall W near a junction with the ceiling C and down towards the floor. These rays show how at different angles of admittance, the light will filter through in a pattern generated to illuminate the wall W in a uniform fashion.

As illustrated in FIG. 9, most of the light leaves the LED(s) 20 within a 120 degree angle N around the surface-normal of the light source 18, although light may be emitted generally in a hemisphere from the LED 20. Once inside the light tube 26, light reflects off of the reflecting walls 78, 86, or the reflective coating if applied, and also reflects internally within the light tube 26, thereby traveling down the light tube 26 along the axis E to the light-emitting surface 58. Prisms 62 on the light-emitting surface 58 refract the light and/or the patterning on the prisms 62 diffuse the light. As illustrated in FIG. 10, at the extreme, light transmitting from the light-emitting surface 58 fills an approximate 80 to 89 degree beam spread K leaving the light pipe 26 directly from the surface 58. The light in the beam spread K is directed through the opening 16 and at the wall W, without obstruction. For example, if the light emitting surface 58 is moved closer to the output plane P, then the beam spread K may be about 89 degrees such that light illuminates the wall W very near the ceiling C. Preferably, the beam spread K is controlled to reduce or eliminate light directed towards the room side R, e.g., to reduce glare. Glare may also be controlled by the light-emitting surface 58 facing away from the room side R (i.e., no form factor to the room) and the design of the first reflector 30. The remainder of the light enters the room R after being reflected off the reflecting surface 74, as illustrated generally at ray L.

Thus, the disclosure provides, among other things, a lighting fixture having a light tube with elongated prisms and an elongated reflector for illuminating a wall in a uniform fashion. Various features and advantages of the disclosure are set forth in the following claims.

What is claimed is:

1. A lighting fixture, comprising:

a generally cuboid main housing elongated in a longitudinal direction;

a light source for emitting light;

a solid light tube of light-permeable material mounted in the main housing for receiving the light, the light tube being elongated in the longitudinal direction and including a base, a first wall extending from the base, a second wall extending from the base, and a light-emitting surface having generally linear, elongated prisms extending in the longitudinal direction for refracting the light, the first wall and the second wall oriented parallel to each other, the first wall oriented perpendicular to the base and including a first edge distal with respect to the base, the second wall oriented perpendicular to the base and including a second edge distal with respect to the base and located closer to the base than the first edge; and a reflecting surface elongated in the longitudinal direction and at least partially facing the light-emitting surface for receiving the refracted light and reflecting the refracted light.

2. The lighting fixture of claim 1, wherein the light tube has a generally extruded shape extending in the longitudinal direction and includes a recess for receiving the light source or a plurality of recesses for receiving a plurality of light sources, wherein the recess or the plurality of recesses extend in the longitudinal direction.

3. The lighting fixture of claim 1, wherein the main housing includes an opening for emitting light, the opening being disposed in an output plane, and wherein the light-emitting surface is transverse to the output plane.

4. The lighting fixture of claim 1, wherein the prisms are at least approximately right angle prisms.

5. A lighting fixture, comprising:

a main housing being elongated in a longitudinal direction and having an elongated opening;

a light source for emitting light; and a solid light tube of light-permeable material mounted in the main housing for receiving the light, the light tube being elongated in the longitudinal direction and including a base, a first wall extending from and oriented perpendicular to the base, a second wall extending from the base and parallel to the first wall, and a light-emitting surface having generally linear, elongated prisms extending in the longitudinal direction for refracting the light through the opening, the first wall having an edge distal with respect to the base and located farther from the base than an edge of the second wall that is distal with respect to the base.

6. The lighting fixture of claim 5, further comprising a reflecting surface at least partially facing the light-emitting surface for receiving the refracted light and reflecting the refracted light towards the opening.

7. The lighting fixture of claim 6, wherein the reflecting surface is generally planar and elongated in the longitudinal direction.

8. The lighting fixture of claim 5, wherein the main housing is generally cuboid with at least one open face defining the opening.

9. The lighting fixture of claim 5, wherein the light tube has a generally extruded shape extending in the longitudinal direction.

10. The lighting fixture of claim 5, wherein the opening is disposed in an output plane, and wherein the light-emitting surface is transverse to the output plane.

11. The lighting fixture of claim 10, wherein the light-emitting surface is disposed at about 40 to about 50 degrees with respect to the output plane.

12. The lighting fixture of claim 5, wherein the prisms are at least approximately right angle prisms.

13. A light tube for refracting light in a lighting fixture, the light tube comprising:

a solid body of light permeable material elongated in a longitudinal direction and having a base having a light-receiving surface configured to receive light from a light source, a light-emitting surface having generally linear, elongated prisms extending in the longitudinal direction for refracting the light, and a first sidewall and a second sidewall extending from the base, the first sidewall and second sidewall oriented parallel to each other and oriented perpendicularly to the base, the light-emitting surface oriented in a plane extending transversely between the first and second sidewalls, the first sidewall having a height relative to the base that is greater than a height of the second sidewall relative to the base;

wherein the body is configured to internally transmit light from the light-receiving surface to the light-emitting surface, and wherein the body is longer in the longitudinal direction than in a direction generally perpendicular to the longitudinal direction from the base to the light-emitting surface.

14. The light tube of claim 13, wherein the prisms are at least approximately right angle prisms.

15. The light tube of claim 13, wherein the base further includes a recess or a plurality of recesses for receiving the light source, wherein the recess or the plurality of recesses extend in the longitudinal direction.

16. The light tube of claim 15, wherein the recess or the plurality of recesses defines the light-receiving surface, and wherein the light-receiving surface has a partially generally cylindrical shape or a generally semi-spherical shape.

17. The light tube of claim 16, wherein the base further includes two base flanges extending in the longitudinal direction for mounting the light tube.

18. The light tube of claim 13, wherein the light-emitting surface is transverse to the base.

19. The light tube of claim 13, wherein the light-emitting surface includes about 20-25 prisms per inch.

20. The light tube of claim 13, wherein the body has an extruded shape extending in the longitudinal direction.

* * * * *